US009680205B2

(12) United States Patent
Li et al.

(10) Patent No.: US 9,680,205 B2
(45) Date of Patent: Jun. 13, 2017

(54) ELECTRONIC DEVICE WITH PERIPHERAL DISPLAY ANTENNA

(71) Applicant: Apple Inc., Cupertino, CA (US)

(72) Inventors: Qingxiang Li, Mountain View, CA (US); Robert W. Schlub, Cupertino, CA (US); Erik G. de Jong, San Francisco, CA (US); Yuehui Ouyang, Sunnyvale, CA (US); Siwen Yong, Santa Clara, CA (US); Miroslav Samardzija, Mountain View, CA (US); Yiren Wang, San Jose, CA (US); Jiang Zhu, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 248 days.

(21) Appl. No.: 14/468,217

(22) Filed: Aug. 25, 2014

(65) Prior Publication Data

US 2016/0056526 A1 Feb. 25, 2016

(51) Int. Cl.
*H01Q 1/24* (2006.01)
*H01Q 9/42* (2006.01)

(52) U.S. Cl.
CPC ..... *H01Q 1/243* (2013.01); *H01Q 9/42* (2013.01)

(58) Field of Classification Search
None
See application file for complete search history.

(56) References Cited

U.S. PATENT DOCUMENTS

| | | | |
|---|---|---|---|
| 5,768,217 | A | 6/1998 | Sonoda et al. |
| 6,825,751 | B1 | 11/2004 | Kita et al. |
| 7,233,291 | B2 | 6/2007 | Elkobi et al. |
| 7,506,436 | B2 | 3/2009 | Bachman |
| 7,815,820 | B2 | 10/2010 | Tan et al. |
| 8,502,739 | B2 | 8/2013 | Ollikainen et al. |
| 8,679,393 | B1 | 3/2014 | Willwerth et al. |
| 8,766,858 | B2 | 7/2014 | Li et al. |
| 8,780,581 | B2 | 7/2014 | Merz et al. |
| 8,803,745 | B2 | 8/2014 | Dabov |
| 2010/0193972 | A1 | 8/2010 | Yamamoto et al. |

(Continued)

FOREIGN PATENT DOCUMENTS

| | | |
|---|---|---|
| EP | 2302658 | 3/2011 |
| EP | 2474872 | 7/2012 |

(Continued)

*Primary Examiner* — Robert Karacsony
(74) *Attorney, Agent, or Firm* — Treyz Law Group, P.C.; G. Victor Treyz; Michael H. Lyons

(57) ABSTRACT

An electronic device may be provided with electrical components mounted in a housing. The electronic device may include wireless transceiver circuitry and antenna structures. A display may be mounted in the housing. The display may have a transparent layer such as display cover layer. The display cover layer may have an inner surface with a recess. The recess may be a groove that runs along a peripheral edge of the display cover layer. An antenna structure such as an inverted-F antenna resonating element may be formed from a metal trace on a plastic support structure. The metal trace and support structure may be mounted in the groove with adhesive. The housing may be a metal housing that forms an antenna ground. Springs may be used in forming an antenna feed and an antenna return path that couples the antenna resonating element to ground.

20 Claims, 15 Drawing Sheets

(56) References Cited

U.S. PATENT DOCUMENTS

| | | | | |
|---|---|---|---|---|
| 2011/0186324 | A1 | 8/2011 | Hur et al. | |
| 2011/0210825 | A1 | 9/2011 | Murakami et al. | |
| 2011/0222248 | A1 | 9/2011 | Sakai et al. | |
| 2011/0241949 | A1 | 10/2011 | Nickel et al. | |
| 2012/0028679 | A1 | 2/2012 | Ozasa | |
| 2012/0133597 | A1 | 5/2012 | Chen | |
| 2012/0223865 | A1* | 9/2012 | Li | H01Q 9/42 343/702 |
| 2013/0044074 | A1 | 2/2013 | Park et al. | |
| 2013/0052947 | A1 | 2/2013 | Kole et al. | |
| 2013/0078917 | A1 | 3/2013 | Cho et al. | |
| 2013/0140965 | A1 | 6/2013 | Franklin et al. | |
| 2013/0229362 | A1 | 9/2013 | Liu et al. | |
| 2013/0234910 | A1 | 9/2013 | Oh et al. | |
| 2013/0300618 | A1 | 11/2013 | Yarga et al. | |
| 2013/0321216 | A1 | 12/2013 | Jervis et al. | |
| 2014/0080411 | A1 | 3/2014 | Konanur et al. | |
| 2014/0112511 | A1* | 4/2014 | Corbin | H05K 9/006 381/333 |
| 2014/0132462 | A1 | 5/2014 | Ying | |
| 2014/0133074 | A1 | 5/2014 | Zahler et al. | |
| 2014/0170975 | A1 | 6/2014 | Liao | |
| 2014/0209691 | A1 | 7/2014 | Finn et al. | |
| 2014/0213178 | A1 | 7/2014 | Wolff et al. | |
| 2014/0218250 | A1 | 8/2014 | Kim et al. | |
| 2014/0226291 | A1 | 8/2014 | Gibbs et al. | |
| 2014/0232609 | A1* | 8/2014 | Lee | H01P 11/00 343/873 |
| 2015/0035709 | A1 | 2/2015 | Lim et al. | |
| 2015/0207913 | A1 | 7/2015 | Nakano et al. | |
| 2015/0311960 | A1* | 10/2015 | Samardzija | G06F 1/163 455/90.3 |
| 2015/0351292 | A1 | 12/2015 | Chang et al. | |

FOREIGN PATENT DOCUMENTS

| | | |
|---|---|---|
| EP | 2869398 | 5/2015 |
| KR | 10-2014-0024543 | 3/2014 |
| WO | 2009014366 | 1/2009 |
| WO | 2013149515 | 10/2013 |
| WO | 2013190119 | 12/2013 |

* cited by examiner

ELECTRONIC DEVICE WITH PERIPHERAL DISPLAY ANTENNA

BACKGROUND

This relates generally to electronic devices and, more particularly, to electronic devices with wireless communications circuitry.

Electronic devices often include wireless communications circuitry. Radio-frequency transceivers are coupled to antennas to support communications with external equipment. During operation, a radio-frequency transceiver uses an antenna to transmit and receive wireless signals.

It can be challenging to incorporate wireless components such as antenna structures within an electronic device. If care is not taken, an antenna may consume more space within a device than desired or may exhibit unsatisfactory wireless performance.

It would therefore be desirable to be able to provide improved antennas for electronic devices.

SUMMARY

An electronic device may be provided with electrical components mounted in a housing. The electrical components may include a wireless transceiver, an antenna, and other wireless circuitry.

A display may be mounted in the housing. The electronic device may have opposing front and rear faces. The display may form the front face of the device and the housing may have a rear wall that forms the rear face of the device. The display may have a transparent layer such as display cover layer that is mounted to housing sidewalls.

The display cover layer may have an inner surface with a recess. The recess may have the shape of a groove that runs along a peripheral edge of the display cover layer.

An antenna structure such as an inverted-F antenna resonating element may be formed from a metal trace on a plastic antenna support structure. The metal trace and support structure may be mounted in the groove with adhesive. The housing may be a metal housing that forms an antenna ground. An inverted-F antenna may be formed from the metal antenna trace in the groove and the metal housing serving as antenna ground.

Springs may be used in forming an antenna feed and an antenna return path. An antenna feed terminal may be formed using a spring on a flexible printed circuit. A return path that couples the antenna resonating element to ground may be formed from another spring. The return path spring may be embedded within a plastic spring biasing structure. The spring biasing structure may be secured to the metal housing using screws. When the spring biasing structure is attached to the housing, the springs may be pressed against contacts formed from portions of the metal trace on the plastic antenna support structure.

DETAILED DESCRIPTION

Figure 1:
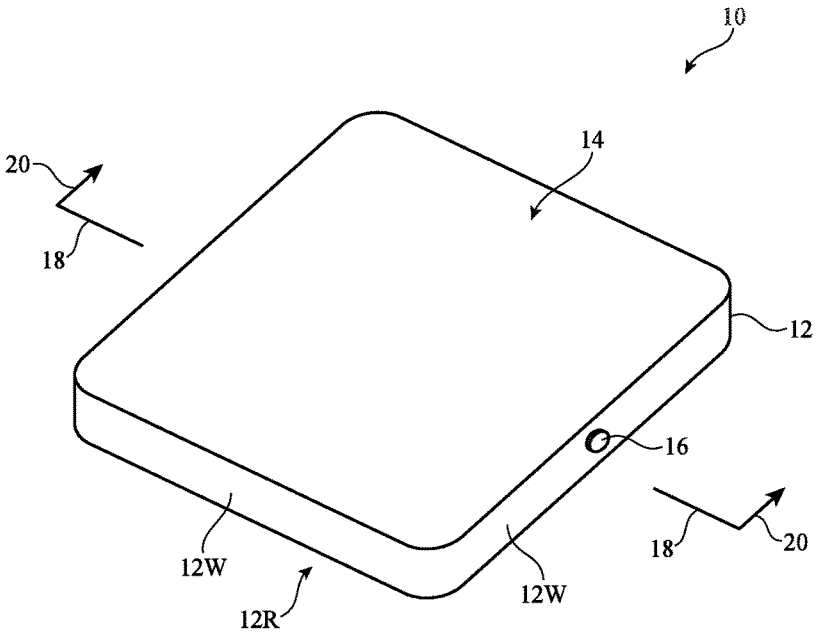
FIG. 1 is a perspective view of an illustrative electronic device with wireless communications circuitry in accordance with an embodiment.

An electronic device such as electronic device 10 of FIG. 1 may contain wireless circuitry. Device 10 may contain wireless communications circuitry that operates in long-range communications bands such as cellular telephone bands and wireless circuitry that operates in short-range communications bands such as the 2.4 GHz Bluetooth® band and the 2.4 GHz and 5 GHz WiFi® wireless local area network bands (sometimes referred to as IEEE 802.11 bands or wireless local area network communications bands). Device 10 may also contain wireless communications circuitry for implementing near-field communications, light-based wireless communications (e.g., infrared light communications and/or visible light communications), satellite navigation system communications, or other wireless communications. Illustrative configurations for the wireless circuitry of device 10 in which wireless communications are performed over a 2.4 GHz communications band and/or 5

GHz communications band (e.g., a Bluetooth® and/or WiFi® link) are sometimes described herein as an example.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

In the example of FIG. 1, device 10 includes a display such as display 14 mounted in housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Device 10 may have opposing front and rear faces surrounded by sidewalls. Display 14 may have a planar or curved outer surface that forms the front face of device 10. The lower portion of housing 12, which may sometimes be referred to as rear housing wall 12R, may form the rear face of housing 12. Rear housing wall 12R may have a planar exterior surface (e.g., the rear of housing 12 may form a planar rear face for housing 12) or rear housing wall 12R may have a curved exterior surface or an exterior surface of other suitable shapes. Sidewalls 12W may have vertical exterior surfaces (e.g., surfaces that run vertically between display 14 and rear housing wall 12R), may have curved surfaces (e.g., surfaces that bow outwardly when viewed in cross section), may have beveled portions, may have profiles with straight and/or curved portions, or may have other suitable shapes. Device 10 may have a rectangular display and rectangular outline, may have a circular shape, or may have other suitable shapes.

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels or other light-emitting diodes, an array of electrowetting display pixels, or display pixels based on other display technologies.

Device 10 may include buttons such as button 16. There may be any suitable number of buttons in device 10 (e.g., a single button, more than one button, two or more buttons, five or more buttons, etc. Buttons may be located in openings in housing 12 or in an opening in a display (as examples). Buttons may be rotary buttons, sliding buttons, buttons that are actuated by pressing on a movable button member, etc. Button members for buttons such as button 16 may be formed from metal, glass, plastic, or other materials.

Figure 2:
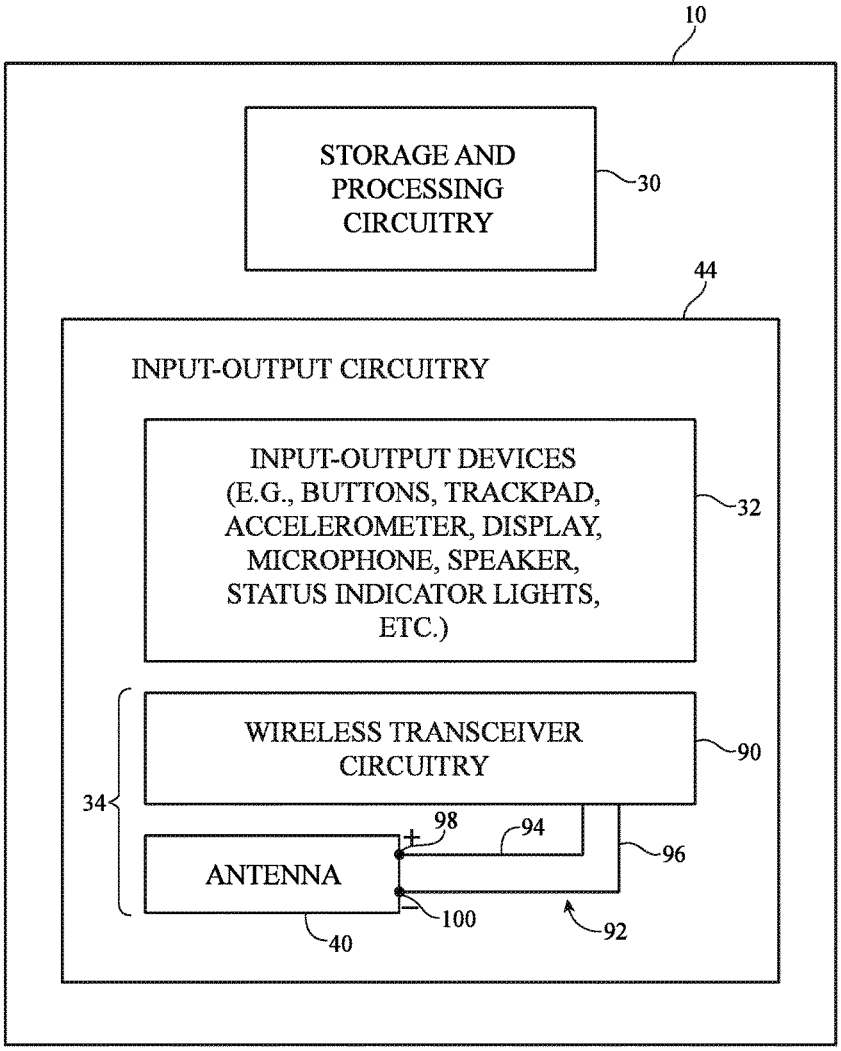
FIG. 2 is a schematic diagram of an illustrative electronic device with wireless communications circuitry in accordance with an embodiment.

A schematic diagram showing illustrative components that may be used in device 10 is shown in FIG. 2. As shown in FIG. 2, device 10 may include control circuitry such as storage and processing circuitry 30. Storage and processing circuitry 30 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 30 may be used to control the operation of device 10. This processing circuitry may be based on one or more microprocessors, microcontrollers, digital signal processors, baseband processor integrated circuits, application specific integrated circuits, etc.

Storage and processing circuitry 30 may be used to run software on device 10. For example, software running on device 10 may be used to process input commands from a user that are supplied using input-output components such as buttons, a touch screen such as display 14, force sensors (e.g., force sensors that are activated by pressing on display 14 or portions of display 14), accelerometers, light sensors, and other input-output circuitry. To support interactions with external equipment, storage and processing circuitry 30 may be used in implementing communications protocols. Communications protocols that may be implemented using storage and processing circuitry 30 include internet protocols, wireless local area network protocols (e.g., IEEE 802.11 protocols—sometimes referred to as WiFi®), protocols for other short-range wireless communications links such as the Bluetooth® protocol, etc.

Device 10 may include input-output circuitry 44. Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices may include touch screens, displays without touch sensor capabilities, buttons, force sensors, joysticks, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors (e.g., a capacitive proximity sensor and/or an infrared proximity sensor), magnetic sensors, and other sensors and input-output components.

Input-output circuitry 44 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include wireless local area network transceiver circuitry that may handle 2.4 GHz and 5 GHz bands for WiFi® (IEEE 802.11) communications, wireless transceiver circuitry that may handle the 2.4 GHz Bluetooth® communications band, cellular telephone transceiver circuitry for handling wireless communications in communications bands between 700 MHz and 2700 MHz or other suitable frequencies (as examples), or other wireless communications circuits. If desired, wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, satellite navigation system receiver circuitry, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles. To conserve power, it may be desirable in some embodiments to configure wireless communications circuitry 34 so that transceiver 90 handles exclusively short-range wireless links such as 2.4 GHz links and/or 5 GHz links (e.g., Bluetooth® and/or WiFi® links). Other configurations may be used for wireless circuitry 34 if desired (e.g., configurations with coverage in additional communications bands).

Wireless communications circuitry 34 may include one or more antennas such as antenna 40. Antenna 40 may be formed using any suitable antenna type. For example, antenna 40 may be an antenna with a resonating element that is formed from loop antenna structures, patch antenna structures, inverted-F antenna structures, slot antenna structures, planar inverted-F antenna structures, helical antenna structures, hybrids of these designs, etc.

Transmission line paths such as transmission line 92 may be used to couple antenna 40 to transceiver circuitry 90. Transmission line 92 may be coupled to antenna feed structures associated with antenna structures 40. As an example, antenna structures 40 may form an inverted-F antenna or other type of antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Other types of antenna feed arrangements may be used if desired. The illustrative feeding configuration of FIG. 2 is merely illustrative.

Transmission line 92 may include coaxial cable paths, microstrip transmission lines, stripline transmission lines, edge-coupled microstrip transmission lines, edge-coupled stripline transmission lines, transmission lines formed from combinations of transmission lines of these types, etc. Filter circuitry, switching circuitry, impedance matching circuitry, and other circuitry may be interposed within the transmission lines, if desired. Circuits for impedance matching circuitry may be formed from discrete components (e.g., surface mount technology components) or may be formed from housing structures, printed circuit board structures, traces on plastic supports, etc. Components such as these may also be used in forming filter circuitry.

Figure 3:
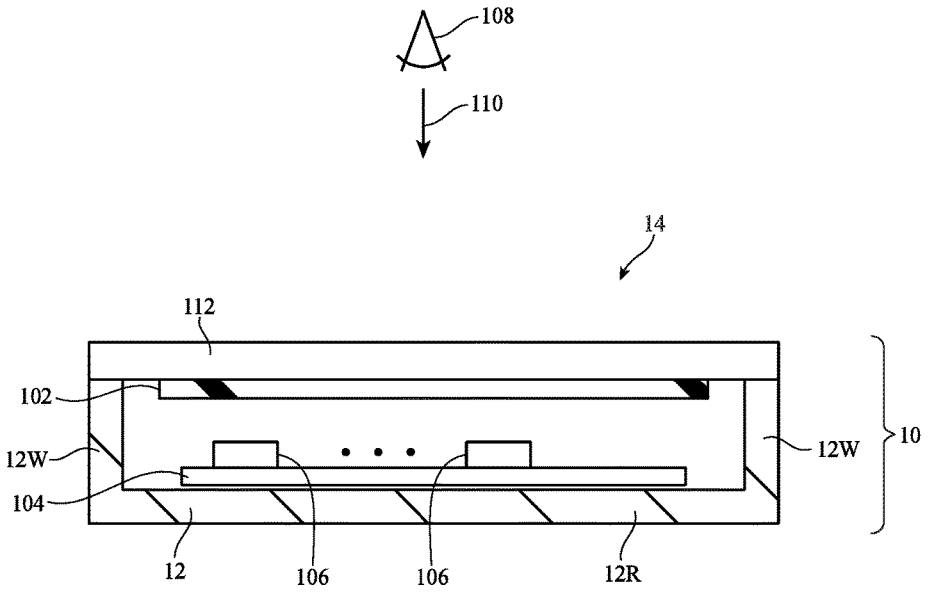
FIG. 3 is a cross-sectional side view of an illustrative electronic device with a planar display in accordance with an embodiment.

Electrical components for forming circuitry such as storage and processing circuitry 30 and input-output circuitry 44 of FIG. 2 may be mounted in housing 12. Consider, as an example, the cross-sectional side view of device 10 of FIG. 3. FIG. 3 is a cross-sectional side view of a device such as device 10 of FIG. 1 taken along line 18 and viewed in direction 20. As shown in FIG. 3, display 14 of device 10 may be formed from a display module such as display module 102 (sometimes referred to as a display) mounted under a cover layer such as display cover layer 112 (as an example). Display 14 (display module 102) may be a liquid crystal display, an organic light-emitting diode display, a plasma display, an electrophoretic display, a display that is insensitive to touch, a touch sensitive display that incorporates and array of capacitive touch sensor electrodes or other touch sensor structures, or may be any other type of suitable display. Display cover layer 112 may be layer of clear glass, a transparent plastic member, a transparent crystalline member such as a sapphire layer, a ceramic, fused silica, a transparent layer formed from one or more different types of materials, or other clear structure. Layer 112 may form the front face of device 10. If desired, the outermost layer of display 14 (e.g., display layer 112) may be used as a substrate for an array of color filter elements (i.e., layer 112 may be a color filter layer), as a substrate for thin-film transistor circuitry (i.e., layer 112 may be a thin-film transistor layer), or may be a substrate that includes both thin-film transistor circuitry and color filter circuitry (as examples).

Device 10 may have inner housing structures that provide structural support to device 10 and/or that serve as mounting platforms for printed circuits and other structures. Structural internal housing members may sometimes be referred to as housing structures and may be considered to form part of housing 12.

Electrical components 106 for forming circuitry such as circuitry 30 and 44 may be mounted within the interior of housing 12. Components 106 may be mounted to printed circuits such as printed circuit 104. Printed circuit 104 may be a rigid printed circuit board (e.g., a printed circuit board formed from fiberglass-filled epoxy or other rigid printed circuit board material) or may be a flexible printed circuit (e.g., printed circuit formed from a sheet of polyimide or other flexible polymer layer). Patterned metal traces within printed circuit board 104 may be used to form signal paths between components 106. If desired, components such as connectors may be mounted to printed circuit 104. Cables such as one or more flexible printed circuit cables may have mating connectors and may couple circuitry on printed circuits such as printed circuit 104 to display 102, to antenna(s) 40 (FIG. 2), etc. Flexible printed circuit cables may also be mounted to boards such as board 104 using solder or other conductive material.

The outermost layer of display 14 such as display cover layer 112 is preferably a transparent display layer that is formed from transparent structures that allow light from display 102 to pass through layer 112. This allows images on display 102 to be viewed by viewer 108 in direction 110 during operation of device 10.

Figure 4:
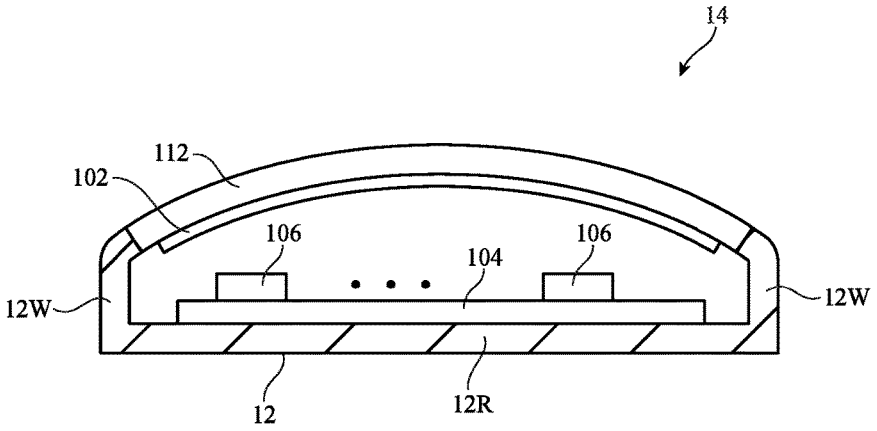
FIG. 4 is a cross-sectional side view of an illustrative electronic device with a curved display in accordance with an embodiment.

In the example of FIG. 3, transparent display cover layer 112 has planar inner and outer surfaces. If desired, one or more of the surfaces of display 14 may be curved (e.g., concave, convex, etc.). As shown in the illustrative cross-sectional side view of FIG. 4, for example, display 14 may have a convex outer surface. In this type of configuration, display cover layer 112 may have a planar inner surface or a curved inner surface (as shown in FIG. 4).

Figure 5:
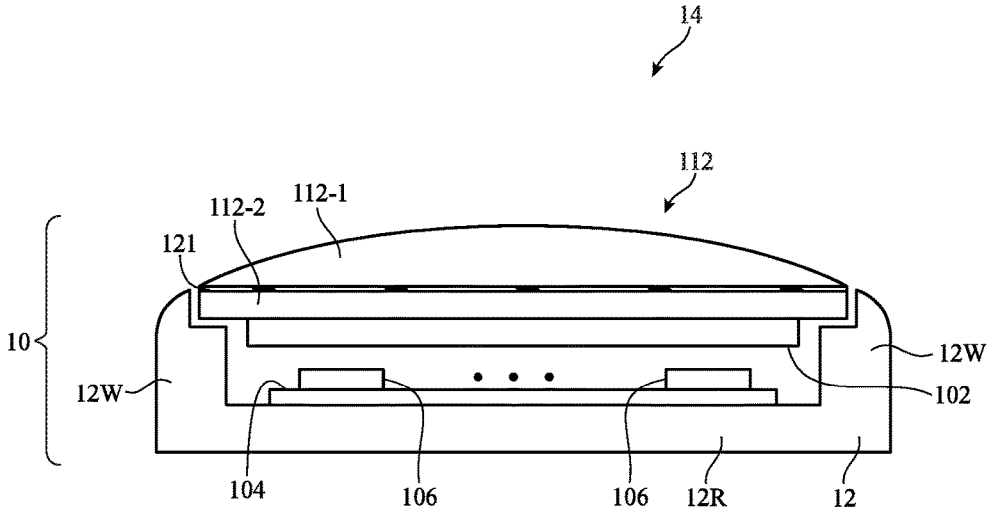
FIG. 5 is a cross-sectional side view of an illustrative electronic device with a display having a curved layer mounted to a planar layer in accordance with an embodiment.

As shown in FIG. 5, display cover layer 112 may have more than one layer. In the FIG. 5 example, display cover layer 112 has an outer layer such as layer 112-1 and an inner layer such as layer 112-2. Layer 112-1 may have a convex outer surface and a planar inner surface (as an example). Layer 112-2 may have opposing planar outer and inner surfaces (as an example). Adhesive 121 (e.g., optically clear adhesive) may be used to attach layers 112-1 and 112-2 together. Display structure 102 (e.g., an organic light-emitting diode display or other display module) may be mounted to the interior surface of lower layer 112-2 (e.g., a planar inner surface) using adhesive or other attachment mechanisms.

Figure 6:
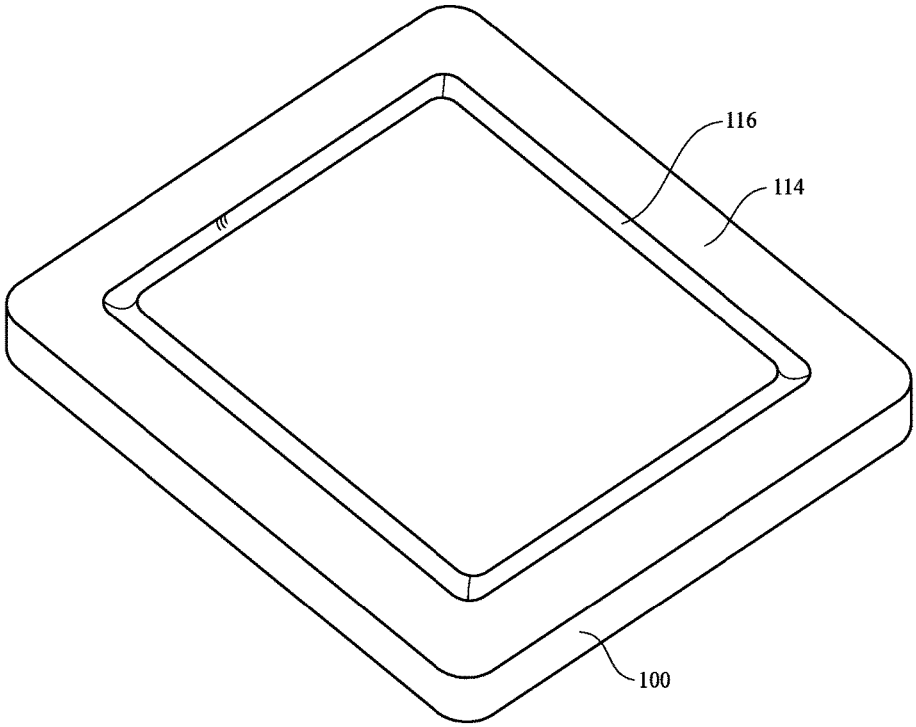
FIG. 6 is a perspective view of an illustrative display layer showing how the interior surface of the display layer may be provided with a recess such as a peripheral groove in accordance with an embodiment.

It may be desirable to create recesses in structures such as housing 12 and/or display 14. As an example, a recess such as groove 116 of FIG. 6 may be formed in inner surface 114 of display cover layer 112. Groove 116 may run along one or more peripheral edges of display cover layer 112. In the FIG. 6 example, display cover layer 112 has a rectangular shape and four peripheral edges. Groove 116 runs along all four peripheral edges of display cover layer 112. Configurations in which recesses such as groove 116 of FIG. 6 have other shapes may also be used, if desired (e.g., configurations in which recess 116 runs along a single edge of display cover layer 112, configurations in which recess 116 runs along two edges of display cover layer 112, configurations in which recess 116 runs along three edges of display cover layer 112, etc.). If desired, display 14 may be circular and recess 116 may form a circular or semicircular groove that runs along the curved edges of display 14 (e.g., recess 116 may be a circular groove or may form a groove that has a curved shape that runs along part of a curved peripheral edge in display 14). Recesses such as groove 116 may be formed by machining, etching, molding, water jet cutting, abrasion using fine particles of grit, or other fabrication techniques. The cross-sectional shape of groove 116 may be square, rectangular, or semicircular, may have curved shapes, may have shapes with straight sides and/or curved sides, etc.

One or more antennas for device 10 may be formed from an antenna resonating element that is fully or partly mounted in a recess such as recess 116. In the illustrative configuration of FIG. 7, antenna 40 is an inverted-F antenna that has an antenna resonating element located within recess 116. Inverted-F antenna 40 of FIG. 7 has antenna resonating element 122 and antenna ground (ground plane) 124. Antenna ground 124 may be formed from a metal housing structure (e.g., housing 12 in a configuration in which some or all of housing 12 is metal), may be formed from conductive traces on a printed circuit board, may be formed from ground structures in other devices (e.g., display 102), and/or may be implemented using other suitable ground structures. Antenna resonating element 122 may have a main resonating element arm such as arm 120. The length of arm 120 (which is sometimes referred to as a resonating element arm or resonating element) may be selected so that antenna 40 resonates at desired operating frequencies. For example, if the length of arm 120 may be a quarter of a wavelength at a desired operating frequency for antenna 40. Antenna 40 may also exhibit resonances at harmonic frequencies.

Arm 120 may be formed from a metal trace on an antenna support. Metal trace 120 may be coupled to ground 124 by return path 126. Return path 126 may be formed from a metal spring or other conductive structure. Antenna feed 128 may include positive antenna feed terminal 98 and ground antenna feed terminal 100 and may be coupled parallel to return path 126 between the metal trace of resonating element arm 120 and ground 124. If desired, inverted-F antennas such as illustrative antenna 40 of FIG. 7 may have more than one resonating arm branch (e.g., to create multiple frequency resonances to support operations in multiple communications bands) or may have other antenna structures (e.g., parasitic antenna resonating elements, tunable components to support antenna tuning, etc.). For example, one end of arm 120 may form a high-band branch that resonates at 5 GHz and another end of arm 120 may form a low-band branch that resonates at 2.4 GHz.

Figure 7:
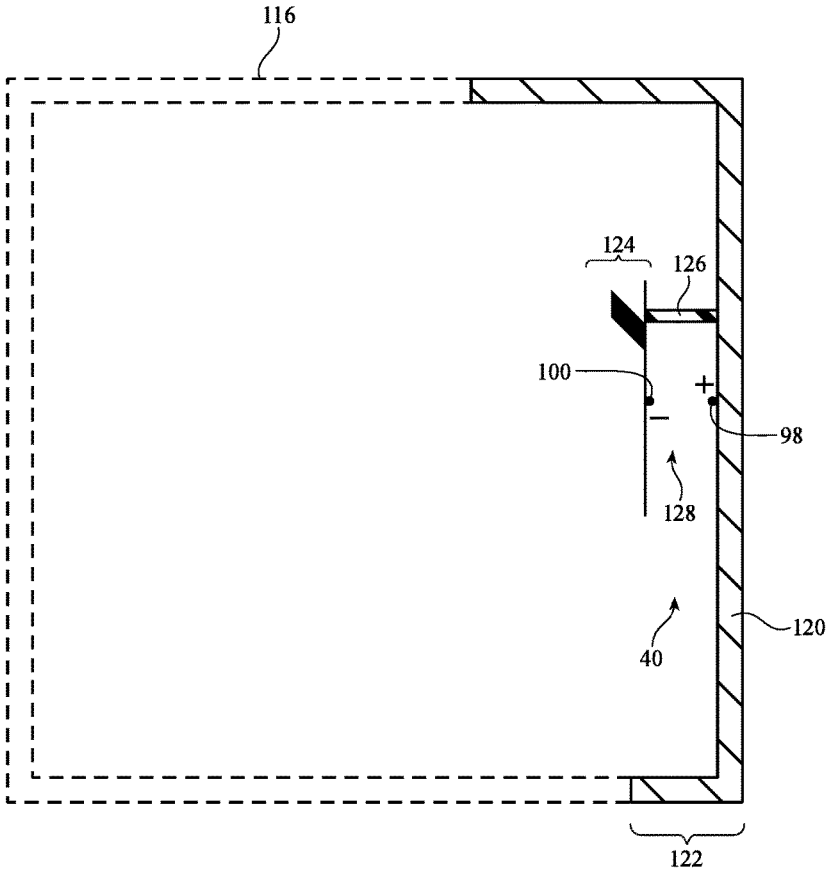
FIG. 7 is a top view of an illustrative antenna of the type that may have an antenna resonating element mounted within a display groove in accordance with an embodiment.

The bandwidth of antennas such as antenna 40 of FIG. 7 may be affected by the separation between ground 124 and antenna resonating element 122 (i.e., the distance between metal trace 120 and housing 12 in a configuration in which ground 124 is formed from housing 12). By providing recesses such as recess 116 in display cover layer 112, the distance between ground 124 and antenna resonating element 120 can be enhanced without overly increasing the size of device 10 and housing 12.

Figure 8:
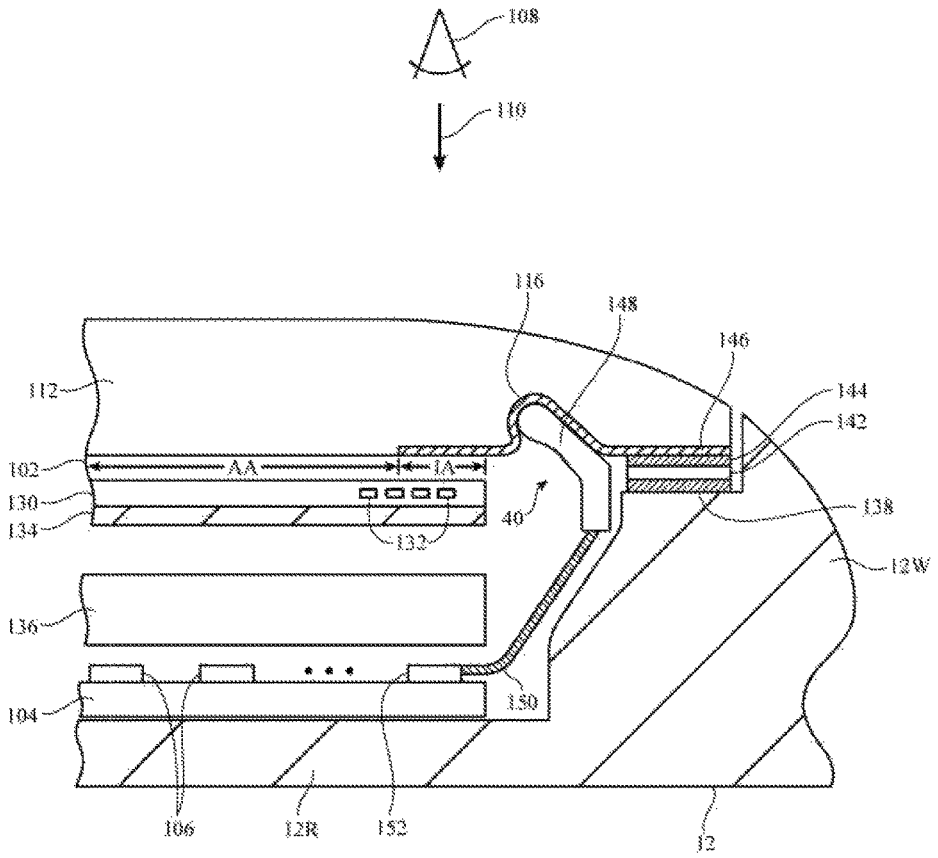
FIG. 8 is a cross-sectional side view of a portion of an electronic device showing how a flexible printed circuit cable may be used to couple radio-frequency transceiver circuitry on a printed circuit board to an antenna structure mounted in a peripheral display groove in accordance with an embodiment.

A cross-sectional side view of antenna 40 taken through an edge portion of device 10 is shown in FIG. 8. As shown in FIG. 8, display 14 may include display cover layer 112 and display module (display) 102. Active area AA of display module 102 may have an array of pixels (e.g., organic light-emitting diode pixels in a configuration in which display module 102 is an organic-light-emitting diode display, etc.) for displaying images. Inactive display border area IA may form a ring that runs around the periphery of display 14 (e.g., a rectangular ring in configurations in which display 14 has a rectangular shape, a circular ring in configuration in which display 14 is circular, etc.).

A near-field communications loop antenna may be formed under display 102. The near-field communications loop antenna may be formed from metal traces 132 on a substrate such as printed circuit 130. Metal traces 132 may be coils that form multiple concentric loops for the near-field communications loop antenna. Metal traces 132 may be overlapped by active area AA and/or inactive area IA of display 102. A magnetic shielding layer such as ferrite layer 134 may be formed under printed circuit 130 and may prevent magnetic fields from the near-field communications antenna from inducing eddy currents in underlying conductive structures such as metal traces in printed circuit 104.

Components may be mounted in the interior of device 10 between ferrite layer 134 and printed circuit 104. As shown in FIG. 8, for example, a component such as component 136 may overlap printed circuit 104. Component 136 may be an electromechanical actuator (e.g., a haptic feedback device, a piezoelectric actuator, a solenoid, a vibrator for issuing alerts, a device for imparting other vibrations or motions to device 10, etc.) or may be any other suitable electrical component(s).

Antenna 40 may be coupled to electrical components 106 on printed circuit 104 using cable 150. Cable 150 may be a flexible printed circuit cable, a coaxial cable, or other signal path (e.g., a path forming transmission line 92). Connector 153 may be used to couple cable 150 to printed circuit 104. Antenna 40 may be formed from an antenna resonating element such as antenna resonating element 122 of FIG. 7 and antenna ground 124 of FIG. 7. Antenna ground 124 may be formed from conductive structures in device 10 such as portions of housing 12 (e.g., metal housing 12).

The antenna resonating element for antenna 40 may be formed from metal traces on a plastic antenna support structure such as antenna trace support structure 148. To hide internal device components from view in direction 110 by user 108, peripheral portions of the inner surface of display cover layer 112 may be coated with a layer of opaque masking material. For example, portions of display cover layer 112 that overlap inactive border region IA of display 102 may be covered with opaque masking layer 146. Layer 146 may overlap inactive display border IA and may cover groove 116 and portions of housing 12 up to the outermost edge of display cover layer 112 (as an example). Opaque masking layer 146 may be formed from black ink, white ink, polymers that are black, white, or have other colors, metals, etc.

As shown in FIG. 8, a component such as force sensor 142 may be coupled between the outer portion of display cover layer 112 and housing 12. Force sensors such as force sensor 142 may be used to detect when a user presses on display cover layer 112 to supply user input to device 10. Adhesive or other attachment mechanisms may be used in mounting sensor 142 in device 10 (see, e.g., adhesive layer 138 and adhesive layer 144). Adhesive such as layers 138 and 144 and/or other fastening mechanisms may be used to attach display cover layer 12 to sidewalls 12W of housing 12.

Antenna trace support structure 148 may be formed from a plastic carrier structure such as a polymer structure formed from liquid crystal polymer or other dielectric support structure. Metal traces on flexible printed circuit cable 150 may form transmission line 92.

Figure 9:
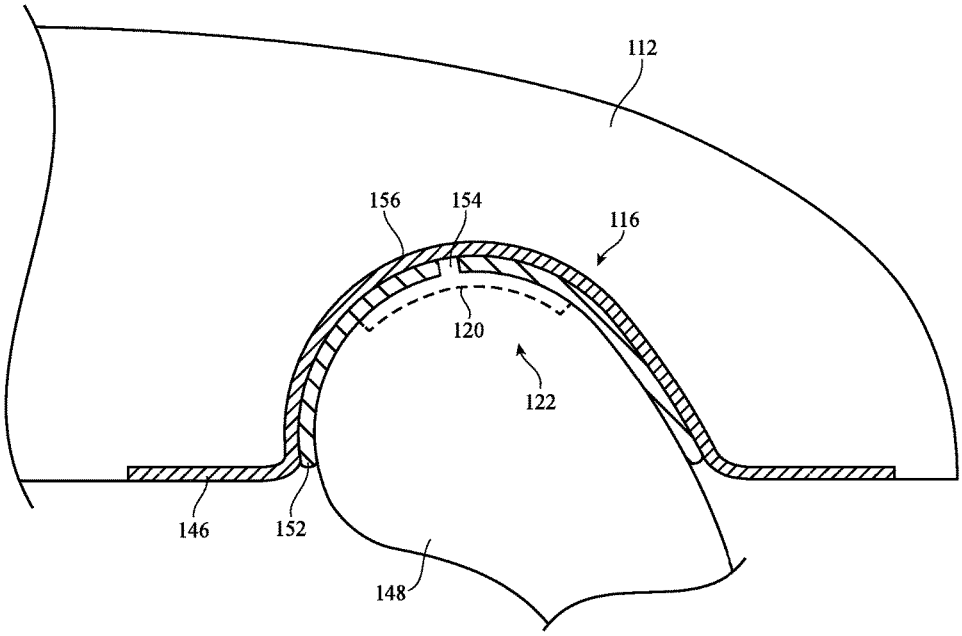
FIG. 9 is a cross-sectional side view of a portion of an electronic device structure having a groove in which an antenna resonating element has been mounted in accordance with an embodiment.

As shown in FIG. 9, antenna trace support structure 148 may be secured within groove 116 in display cover layer 112 using adhesive 152. Opaque masking layer 146 (e.g., black ink) may be interposed between adhesive 152 and inner surface 156 of groove 116. Antenna resonating element 122 may be formed from metal trace 120 on support structure 148. Metal traces may be formed for resonating element 122 using laser-enhanced deposition (e.g., techniques in which selected portions of the surface of structure 148 are activated by application of laser light following which metal is electrochemically deposited on the active regions) or using other deposition and patterning techniques (e.g., shadow masks and evaporation, physical or chemical vapor deposition followed by selected laser ablation or etching, etc.).

Adhesive 152 may be thermally cured adhesive and/or adhesive that is cured by application of light (e.g., ultraviolet light). Support structure 148 may have an elongated shape extending along a longitudinal axis (into the plane in the example of FIG. 9). The longitudinal axis of antenna trace support structure 148 may be aligned with the longitudinal axis of groove 116.

Adhesive gap formation structures such as protrusions 154 may be formed at one or more locations along the length of support structure 148. Protrusions 154 may have heights equal to the amount of gap that is desired between the surface of support structure 148 and inner surface 156 of groove 116. If insufficient space is provided or if too much space is provided for adhesive 152, the joint formed by adhesive 152 may not be satisfactory. By including protrusions 154 along the surface of support structure 148, a desired gap will be created between support structure 148 and groove surface 156 prior to adhesive curing. Protrusion 154 therefore serves as an adhesive gap spacer that ensures that plastic antenna trace support structure 148 is separated from the interior surface of groove 116 by an appropriately sized adhesive gap. The adhesive gap will be filled with a suitable amount of adhesive 152 by virtue of the fixed spacing established by the size of protrusions 154. If desired, other techniques may be used to help ensure that a satisfactory amount of adhesive 152 is interposed between support structure 148 (and therefore metal trace 120 of resonating element 122) and inner surface 156 of groove 116 in display cover layer 112. The configuration of FIG. 9 in which adhesive spacer structures are formed from portions of support structures 148 that protrude outwardly such as protrusion 154 of FIG. 9 is merely illustrative.

Figure 10:
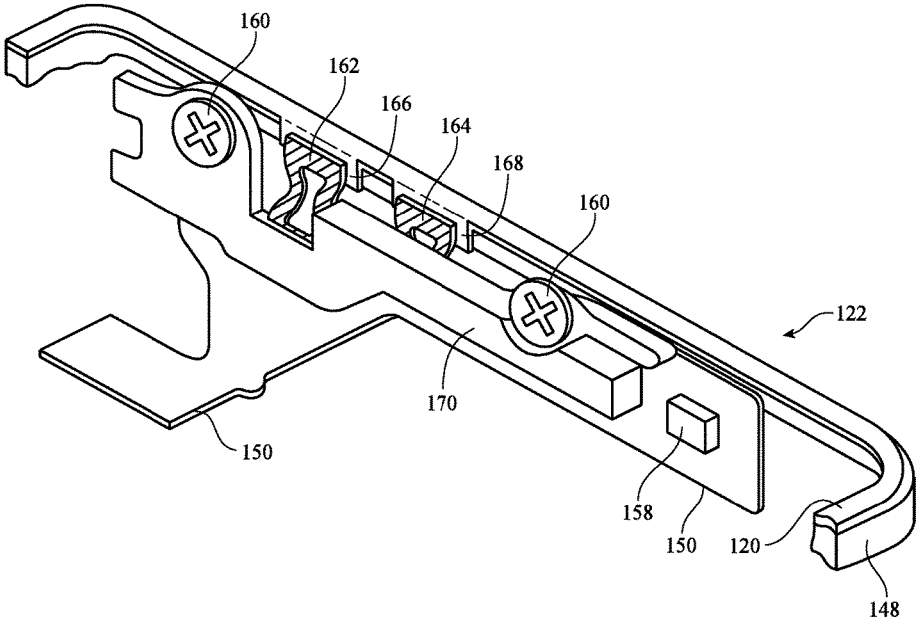
FIG. 10 is a perspective view of an illustrative antenna resonating element and associated flexible printed circuit and antenna feed structures in accordance with an embodiment.

A perspective view of structures associated with antenna 40 is shown in FIG. 10. As shown in FIG. 10, antenna resonating element 122 may be formed from a metal trace on the upper surface of a dielectric support structure such as plastic antenna trace support structure 148. Support structure 148 may have a shape that mates with groove 116 or part of groove 116 on the underside of display cover layer 112. Portions of trace 120 such as portions 166 and 168 may form contact pads that mate with springs or other conductive feed and return path structures for antenna 40. Portions 166 and 168 may, for example, extend downwardly along the inner sidewall surface of dielectric support structures 148. Portions 166 and 168 may be integral portions of trace 120 and may extend downwards from the portion of resonating element trace 120 on the upper surface of support structure 148. Portions 166 and 168 may form antenna resonating element contacts for resonating element 120 at first and second respective locations along the length of resonating element 120.

Conductive structures such as metal springs 162 and 164 may be used to form connections with antenna resonating element 120. Metal spring 162 may, for example, be used in forming return path 126, whereas metal spring 164 may be used in forming antenna feed 128 (FIG. 7). Metal spring 162 may have a first portion that presses against portion 166 of trace 120 (i.e., metal spring 162 may mate with contact 166), thereby forming an electrical connection between spring 162 and antenna resonating element trace 120. Metal spring 162 may also have a second portion that is electrically coupled to antenna ground 124 (e.g., housing 12). For example, metal screws 160 may be used to short metal spring 162 to housing 12. When mounted in device 10 in this way, metal spring 162 forms a return path such as return path 126 of FIG. 7 that couples antenna resonating element 120 to ground 124. Metal spring 164 may have an end that is pressed against mating contact 168, thereby forming feed terminal 98 in antenna feed 128. Metal spring 164 may have an opposing end that is coupled to a positive transmission line signal trace such as path 94 on flexible printed circuit 150.

Flexible printed circuit 150 may have metal traces for signal paths such as positive signal path 94 and ground signal path 96 for transmission line 92. With one suitable arrangement, spring 162 is partly embedded within a plastic support structure such as plastic spring biasing structure 170 and is electrically coupled to metal housing 12 via screws 160, whereas spring 164 is soldered to a contact on flexible printed circuit 150 and is pressed towards trace 120 via spring biasing structure 170. If desired, both spring 162 and spring 164 may be soldered to respective contacts on flexible printed circuit 150, both spring 162 and spring 164 may be fully and/or partly embedded within plastic spring biasing structure 170, or spring 162 and/or spring 164 may be supported using other mounting structures (e.g., metal brackets, dielectric supports, printed circuit substrates, etc.).

If desired, filter circuitry, impedance matching circuitry, and/or other circuit components may be interposed in transmission line path 92. For example, circuitry such as circuitry 158 (e.g., an impedance matching circuit or other circuitry such as filter circuitry, antenna tuning circuitry, switching circuitry, etc.) may be mounted to printed circuit 150 and coupled to the signal lines in transmission line path 92.

Figure 11:
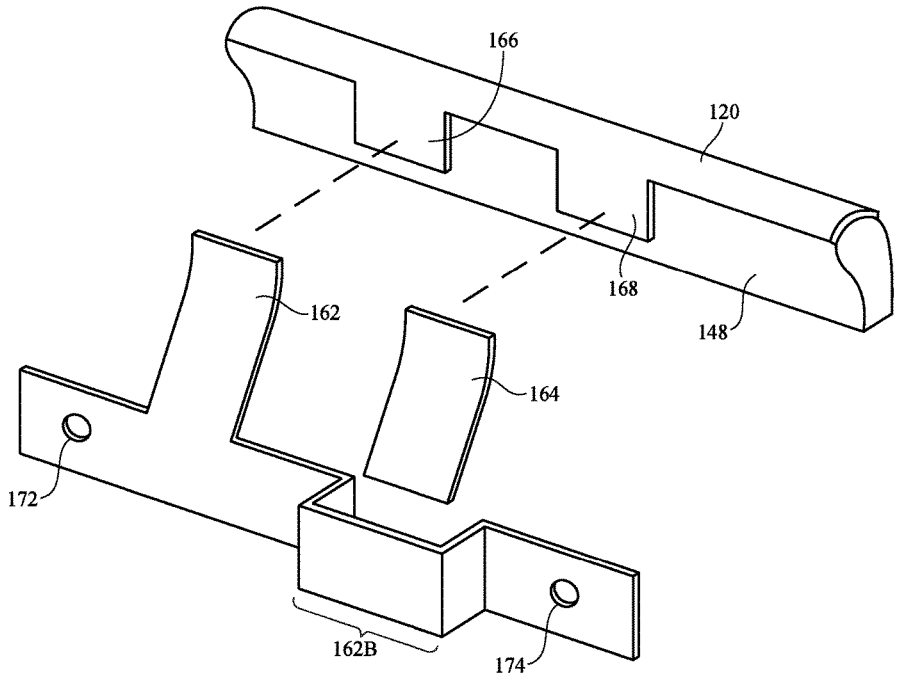
FIG. 11 is a perspective view of a portion of an illustrative antenna resonating element showing how contacts may be formed to mate with springs carrying antenna signals in accordance with an embodiment.

FIG. 11 is a perspective view of a portion of antenna resonating element trace 120 and support structure 148 showing how springs 162 and 166 may mate with resonating element contacts such as return path contact 166 and positive feed terminal contact 168. Springs 162 and 166 may have any suitable shapes. The illustrative shapes of FIG. 11 are merely illustrative. As shown in FIG. 11, springs 162 may have openings (e.g., circular holes, semicircular holes, grooves, etc.) such as openings 172 and 174. During assembly, the shafts of screws 160 may be inserted into openings 172 and 174 to attach spring 162 (and biasing structure 170) to metal housing 12. If desired, spring 162 may have a portion such as portion 162B that bridges spring 164. When biasing structure 170 is attached to housing 12, spring 164 may be pressed against contact 168. In this way, biasing structure 170 presses both springs 162 and 164 into contact with metal trace 120 at different respective locations along the length of metal trace 120.

Figure 12:
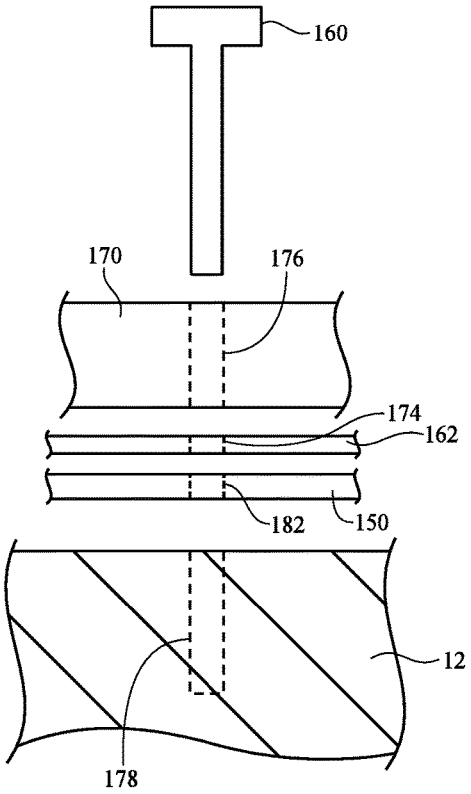
FIG. 12 is a cross-sectional side view of a spring biasing structure and associated screw for attaching the biasing structure to an electronic device housing that serves as antenna ground in accordance with an embodiment.

FIG. 12 is an exploded cross-sectional side view of housing 12 and associated antenna structures in antenna 40. As shown in FIG. 12, flexible printed circuit 150 may be interposed between a spring (e.g., spring 162 in the FIG. 12 example) and housing 12. If desired flexible printed circuit 150 may be interposed between a spring such as spring 162 and biasing structure 170. Portions of spring 162 may contact housing 12 directly and/or may be electrically connected to housing 12 through metal traces in flexible printed circuit 150.

Spring biasing structure 170 may have an opening such as opening 176. Flexible printed circuit 150 may have an opening such as opening 182. Spring 162 may have an opening such as opening 174. Metal housing 12 may have an opening such as threaded opening 178. Openings such as openings 176, 182, 174, and 178 may be circular, semicircular, or may have other suitable shapes and may be aligned with each other to receive the shaft of screw 160 during assembly. When screws 160 are screwed into housing 12, the return path and antenna feed connections for antenna 40 may be formed using springs 162 and 168 and the metal traces of flexible printed circuit 150.

Figure 13:
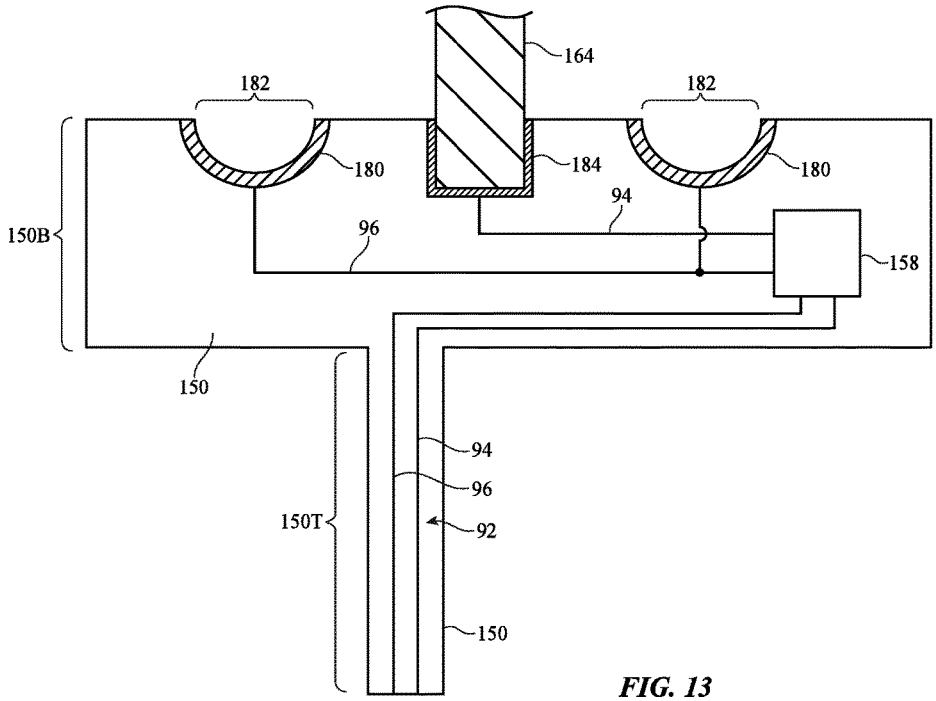
FIG. 13 is a top view of an illustrative spring that may be used to form a return path in an inverted-F antenna in accordance with an embodiment.

FIG. 13 is a top view of flexible printed circuit 150. As shown in FIG. 13, flexible printed circuit 150 may have a main portion such as portion 150B and an extended tail portion such as tail 150T. Transmission line 92 may be formed from metal traces on flexible printed circuit 150 such as positive signal path 94 and ground signal path 96. Impedance matching circuit 158 or other circuitry may be interposed in path 92. Circuitry 158 may be formed from one or more integrated circuits and/or discrete components (e.g., capacitors, resistors, inductors, etc.).

Metal traces on flexible printed circuit 150 may be used in forming an electrode such as pad 184. Spring 164 may be mounted on flexible printed circuit 150 by soldering an end of spring 164 to pad 184 (as an example). Metal traces on flexible printed circuit 150 may also be used in forming electrodes such as electrodes 180. Electrodes 180 may, as an example, form semicircular contacts surrounding semicircular screw hole openings 182 one on or both exterior surfaces of flexible printed circuit 150. When installed in device 10, extended portion 150T may be coupled to a connector on printed circuit board 104 such as connector 153.

Figure 14:
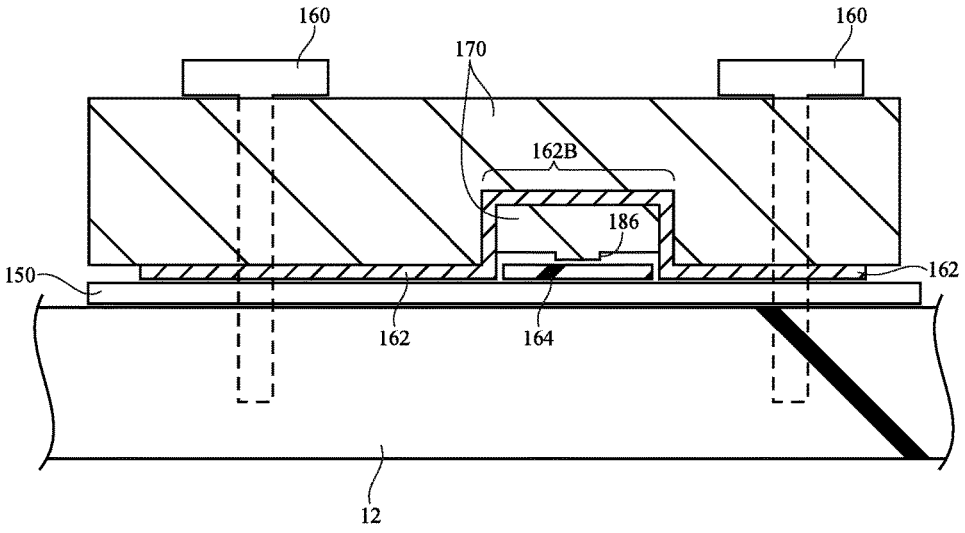
FIG. 14 is a side view of illustrative antenna structures showing how springs and a support structure may be used in forming an antenna feed and return path in accordance with an embodiment.

A cross-sectional side view of a portion of antenna 40 when spring biasing structure 170 is mounted to housing 12 is shown in FIG. 14. As shown in FIG. 14, screws 160 may be screwed into mating threaded openings in housing 12, thereby pressing structure 170 towards housing 12. Structures such as springs 162 and 164 may be pressed towards resonating element 120 and/or housing 12 by spring biasing structure 170 as screws 160 are tightened. Spring 162 may be fully or partly embedded within the plastic of structure 170 (e.g., by injection molding). If desired, structure 170 may have a portion such as protrusion 186 that presses spring 164 towards contact 168 on antenna resonating element 120 when structure 170 is screwed into housing 12.

Figure 15:
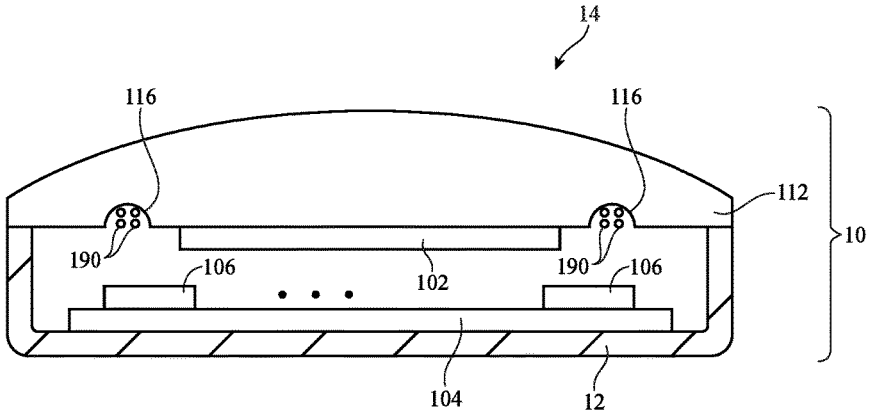
FIG. 15 is a cross-sectional side view of an illustrative electronic device having a near-field communications antenna mounted in a recess in an electronic device structure such as a display layer in accordance with an embodiment.

FIG. 15 is a cross-sectional side view of device 10 in an illustrative configuration in which a near-field communications antenna has been mounted in recess 116. The near-field communications antenna may include one or more coils 190 that form a loop antenna (e.g., in a configuration in which groove 116 runs around the entire periphery of display cover layer 112 and display 14). If desired, other components may be mounted in recesses such as recess 116 (e.g., sensors, switching, capacitor electrodes for a capacitive touch sensor, buttons, force sensors, compass sensors, accelerometers, light-based devices such as light sources and light detectors, audio components, vibrators and other actuators, magnetic sensors, temperature sensors, display components, analog and/or digital circuitry for other device functions, etc. There may be multiple recesses 116 in device 10 and each recess may potentially be formed in a different device structure (e.g., one recess may be formed in display cover layer 112 and another recess may be formed in housing 12 or other device structure). Configurations in which recess 116 is formed in housing 12 and display 14 does not contain any recesses may also be used. Recesses may be formed in the shape of grooves, through-holes, circular depressions or depressions of other shapes, recesses with curved sides, recesses with planar sides, recesses with curved and/or straight edges, etc.

The foregoing is merely illustrative and various modifications can be made by those skilled in the art without departing from the scope and spirit of the described embodiments. The foregoing embodiments may be implemented individually or in any combination.

What is claimed is:

1. An electronic device having opposing front and rear faces, comprising:

a metal housing, wherein the metal housing has a rear wall that forms the rear face of the electronic device and has sidewalls;

a display mounted in the housing;

a transparent display cover layer that covers the display and that is attached to the sidewalls of the metal housing, wherein the transparent display cover layer has an interior surface with a recess;

an antenna having an antenna resonating element in the recess and an antenna ground formed from the metal housing, wherein the antenna resonating element comprises a metal trace on a plastic antenna trace support structure, the plastic antenna trace support structure has an adhesive gap spacer that is configured to separate the plastic antenna trace support structure from an interior surface of the recess by a gap; and adhesive in the gap that attaches the plastic antenna trace support structure and the metal trace in the recess to the interior surface of the transparent display cover layer.

2. The electronic device defined in claim 1 wherein the transparent display cover layer comprises a layer selected from the group consisting of: a glass layer and a sapphire layer.

3. The electronic device defined in claim 2 wherein the recess comprises a groove.

4. The electronic device defined in claim 3 wherein the antenna resonating element comprises an inverted-F antenna resonating element.

5. The electronic device defined in claim 1, wherein the antenna resonating element is coupled to the metal housing by a spring that forms a return path for the antenna.

6. The electronic device defined in claim 2 wherein the electronic device comprises a wristwatch device.

7. The electronic device defined in claim 1 further comprising a force sensor interposed between the transparent display cover layer and the metal housing.

8. An electronic device having opposing front and rear faces, comprising:

a metal housing, wherein the metal housing has a rear wall that forms the rear face of the electronic device and has sidewalls;

a display mounted in the housing;

a transparent display cover layer that covers the display and that is attached to the sidewalls of the metal housing, wherein the transparent display cover layer has an interior surface with a recess;

an inverted-F antenna having an inverted-F antenna resonating element in the recess and an antenna ground formed from the metal housing, wherein the inverted-F antenna resonating element comprises a metal trace formed on a plastic antenna trace support structure;

a flex circuit that is configured to convey radio-frequency signals for the antenna; and a screw that passes through an opening in the flex circuit, secures the flex circuit and the plastic antenna trace support structure to a given one of the sidewalls, and shorts the metal trace to the given one of the sidewalls.

9. The electronic device defined in claim 8 wherein the recess comprises a groove, the plastic antenna trace support structure has an adhesive gap spacer that is configured to separate the plastic antenna trace support structure from an interior surface of the groove by a given gap, and the electronic device further comprises adhesive in the gap that attaches the plastic antenna trace support structure and the metal trace to the groove.

10. The electronic device defined in claim 9 further comprising an opaque masking layer interposed between the adhesive and the inner surface of the groove.

11. The electronic device defined in claim 10 wherein the metal trace has portions forming first and second spring contacts.

12. The electronic device defined in claim 11 further comprising a first spring that presses against the first spring contact and a second spring that presses against the second spring contact.

13. The electronic device defined in claim 12 further comprising a plastic spring biasing structure that presses the first and second springs against the first and second spring contacts.

14. The electronic device defined in claim 13 further comprising a screw that screws the plastic spring biasing structure to the metal housing and that electrically couples the first spring to the metal housing so that the first spring forms a return path for the inverted-F antenna.

15. The electronic device defined in claim 14 further comprising a flexible printed circuit having a signal path shorted to the second spring, wherein the second spring forms a positive antenna feed terminal for the inverted-F antenna.

16. The electronic device defined in claim 15 further comprising an impedance matching circuit mounted on the flexible printed circuit, wherein the first spring is embedded at least partly within the plastic spring biasing structure.

17. The electronic device defined in claim 15 further comprising:

a printed circuit board; and electrical components mounted to the printed circuit board, wherein the flexible printed circuit has a tail that is coupled to the printed circuit board.

18. The electronic device defined in claim 12 wherein the display comprises an organic light-emitting diode display.

19. The electronic device defined in claim 8, further comprising a flexible printed circuit cable that electrically connects the metal trace to wireless transceiver circuitry.

20. An electronic device having opposing front and rear faces, comprising:

a metal housing, wherein the metal housing has a rear wall that forms the rear face of the electronic device and has sidewalls;

a display mounted in the housing;

a transparent display cover layer that covers the display and that is attached to the sidewalls of the metal housing, wherein the transparent display cover layer has an interior surface with a recess;

an antenna having an antenna resonating element in the recess and an antenna ground formed from the metal housing, wherein the recess comprises a ring-shaped groove that runs along a periphery of the display and the antenna resonating element runs along some but not all of the ring-shaped groove.

* * * * *